US009424981B2

(12) United States Patent
Yokoyama et al.

(10) Patent No.: US 9,424,981 B2
(45) Date of Patent: Aug. 23, 2016

(54) INDUCTOR ELEMENT

(71) Applicant: Murata Manufacturing Co., Ltd., Kyoto (JP)

(72) Inventors: Tomoya Yokoyama, Kyoto (JP); Takako Sato, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/505,617

(22) Filed: Oct. 3, 2014

(65) Prior Publication Data

US 2015/0022307 A1 Jan. 22, 2015

Related U.S. Application Data

(63) Continuation of application No. PCT/JP2012/077498, filed on Oct. 24, 2012.

(30) Foreign Application Priority Data

May 15, 2012 (JP) ..... 2012-111300

(51) Int. Cl.

| | |
|---|---|
| ***H01F 5/00*** | (2006.01) |
| ***H01F 27/28*** | (2006.01) |
| ***H01Q 7/06*** | (2006.01) |
| *H01F 17/00* | (2006.01) |
| *H01F 38/14* | (2006.01) |

(52) U.S. Cl.

CPC ..... *H01F 27/2804* (2013.01); *H01F 5/003* (2013.01); *H01Q 7/06* (2013.01); *H01F 17/0033* (2013.01); *H01F 38/14* (2013.01); *H01F 2027/2809* (2013.01)

(58) Field of Classification Search

CPC . H01F 5/003; H01F 27/2804; H01F 17/0033; H01F 17/0013; H01F 2027/2809; H01F 38/14; H01Q 7/06

USPC ..... 336/200, 234, 147, 223

See application file for complete search history.

(56) References Cited

U.S. PATENT DOCUMENTS

| | | | | |
|---|---|---|---|---|
| 2002/0118089 | A1 | 8/2002 | Sakakura | |
| 2005/0179514 | A1 * | 8/2005 | Yamamoto et al. | 336/200 |

(Continued)

FOREIGN PATENT DOCUMENTS

| | | | |
|---|---|---|---|
| CN | 1363938 | A | 8/2002 |
| JP | 2002-252116 | A | 9/2002 |

(Continued)

OTHER PUBLICATIONS

International Search Report issued in Application No. PCT/JP2012/077498 dated Dec. 4, 2012.

(Continued)

*Primary Examiner* — Mangtin Lian

(74) *Attorney, Agent, or Firm* — Pearne & Gordon LLP

(57) ABSTRACT

A multilayer body 12 includes nonmagnetic sheets SH1*a* and SH1*b* each having an upper surface provided with a plurality of linear conductors 16, a magnetic sheet SH3 having an upper surface provided with a plurality of linear conductors 18*a*, and a nonmagnetic sheet SH4 having an upper surface provided with a plurality of linear conductors 18*b*, which are stacked one on top of another. Via-hole conductors or side-surface conductors are disposed with the multilayer body 12 so as to connect these linear conductors to one another and form an inductor. The plurality of linear conductors have a pattern that is common among at least two sheets adjacent to each other in a stacking direction.

7 Claims, 14 Drawing Sheets

(56) References Cited

U.S. PATENT DOCUMENTS

| | | | | |
|---|---|---|---|---|
| 2006/0049905 | A1* | 3/2006 | Maeda et al. | 336/200 |
| 2008/0129629 | A1* | 6/2008 | Kimura et al. | 343/788 |
| 2010/0007457 | A1* | 1/2010 | Yan | H01F 3/14 336/234 |
| 2011/0124299 | A1* | 5/2011 | Koujima | G06K 19/07749 455/73 |
| 2012/0091210 | A1* | 4/2012 | Koujima et al. | 235/492 |

FOREIGN PATENT DOCUMENTS

| | | | |
|---|---|---|---|
| JP | 2002-252117 | A | 9/2002 |
| JP | 2003-017325 | A | 1/2003 |
| JP | 2003-059722 | A | 2/2003 |
| JP | 2004-311830 | A | 11/2004 |
| JP | 2005-167098 | A | 6/2005 |
| JP | 2006-186137 | A | 7/2006 |
| JP | 2007-027649 | A | 2/2007 |
| JP | 2008-035464 | A | 2/2008 |
| WO | WO 2005/060093 | A1 * | 6/2005 |
| WO | 2010/113751 | A1 | 10/2010 |

OTHER PUBLICATIONS

Office action issued in Chinese Appl. No. 201280071818.1 for Inductor Element dated Feb. 3, 2016.

* cited by examiner

A-A CROSS-SECTIONAL VIEW

FIG. 5A PREPARE MOTHER SHEET
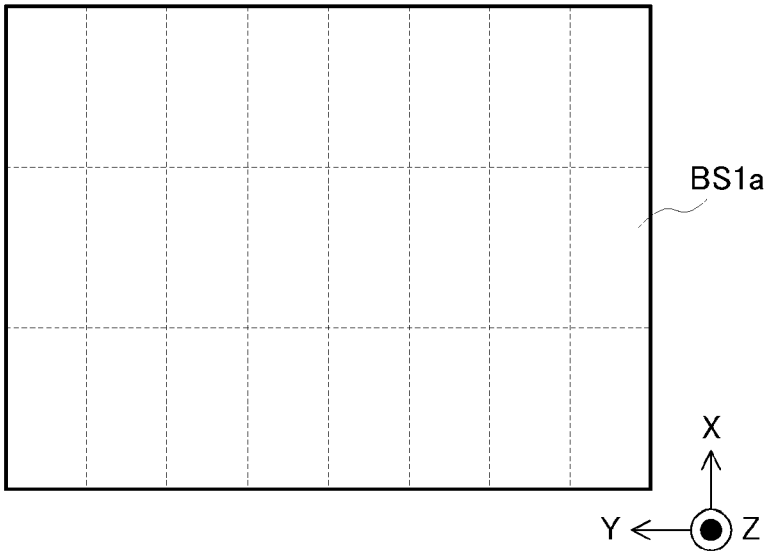
FIG. 5B FORM THROUGH-HOLES
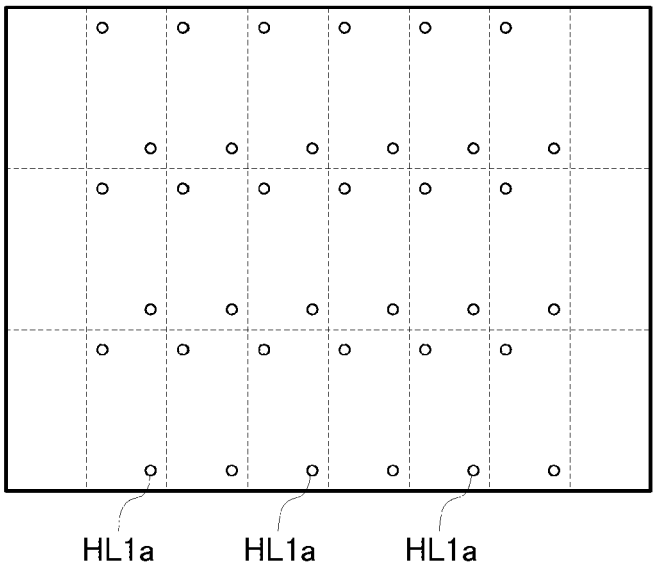

FIG. 6A FILL HOLES WITH CONDUCTIVE PASTE
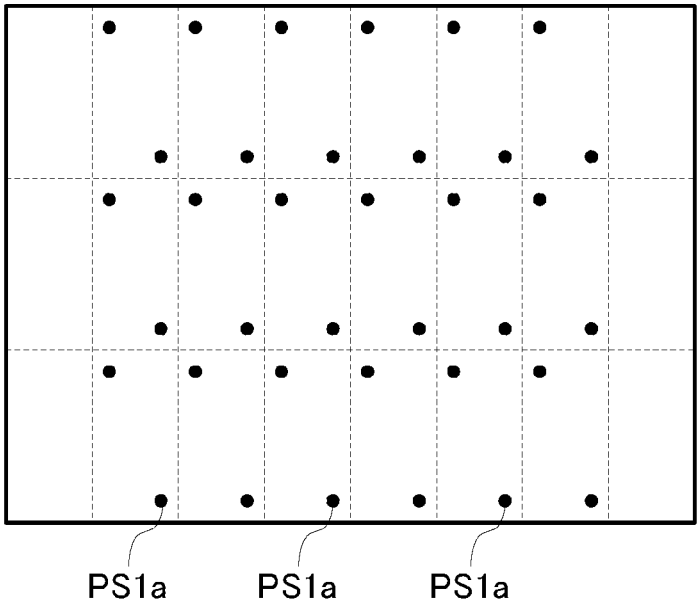
FIG. 6B PRINT COIL PATTERN
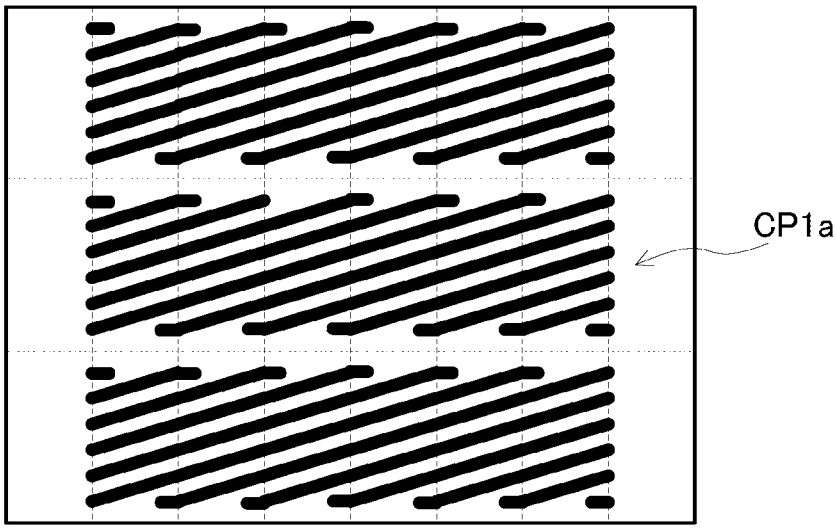

FIG. 7A PREPARE MOTHER SHEET
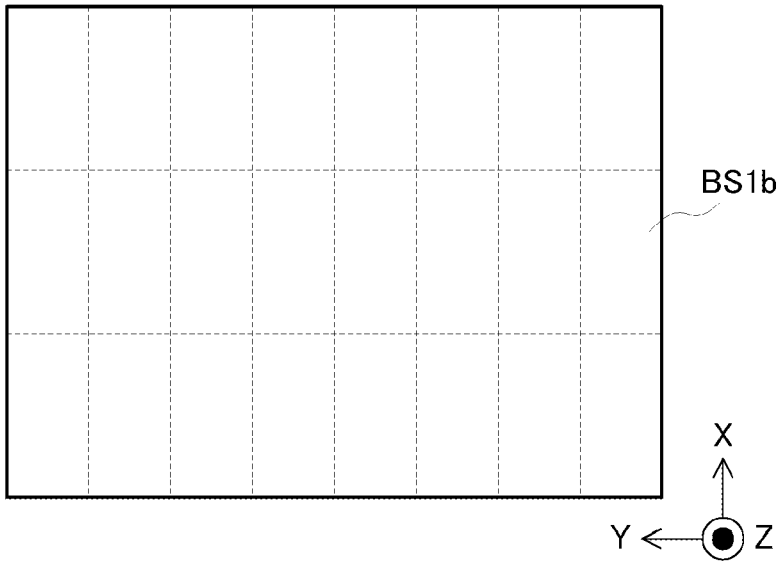
FIG. 7B FORM THROUGH-HOLES
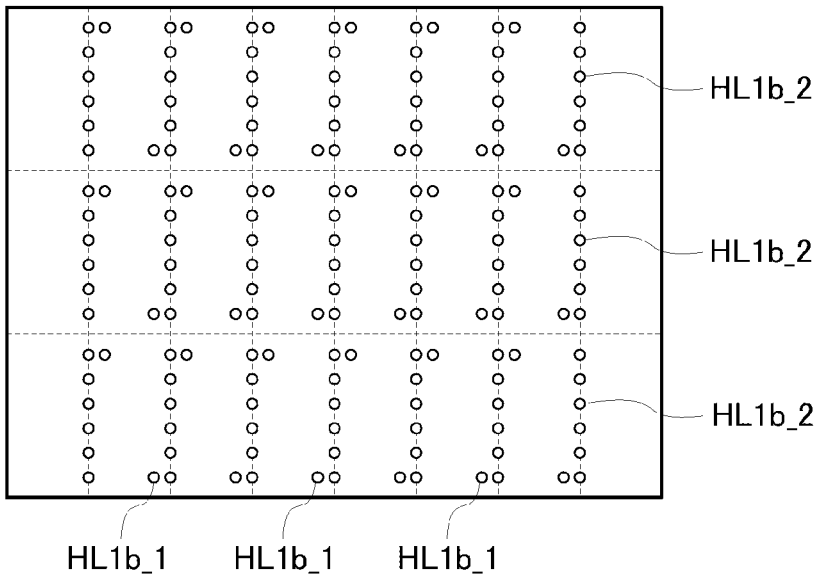

FIG. 8A FILL HOLES WITH CONDUCTIVE PASTE
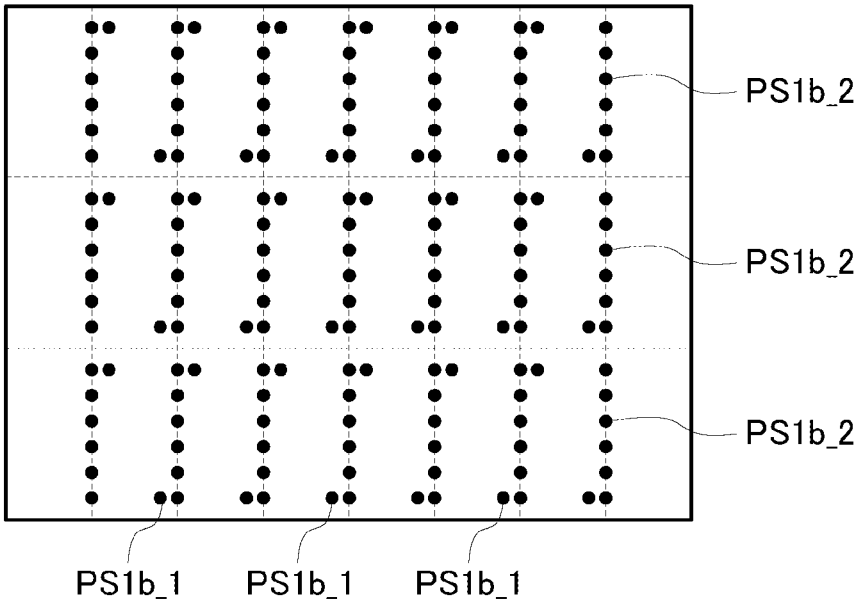
FIG. 8B PRINT COIL PATTERN
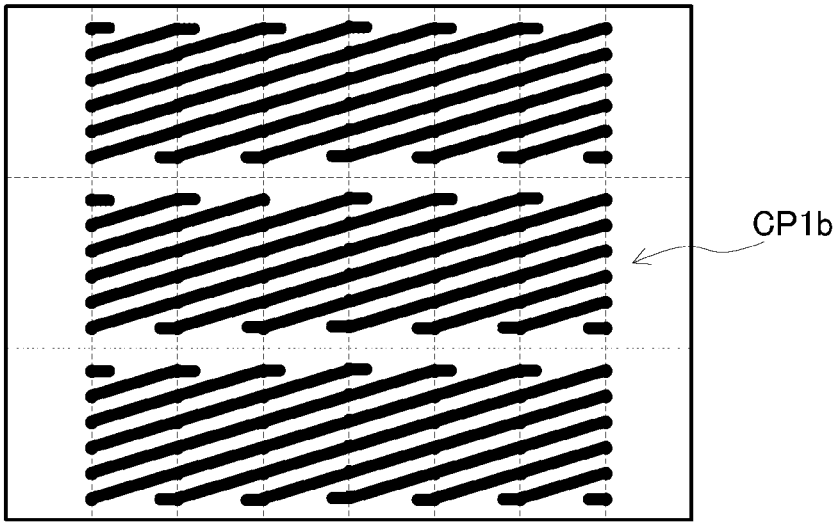

FIG. 9A
PREPARE MOTHER SHEET
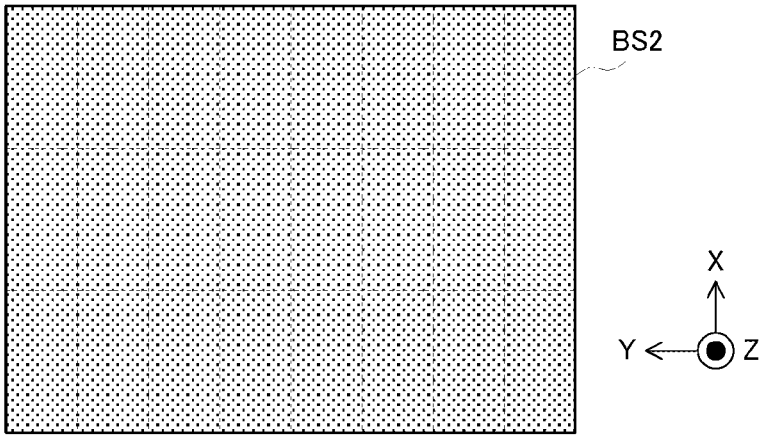
FIG. 9B FORM THROUGH-HOLES
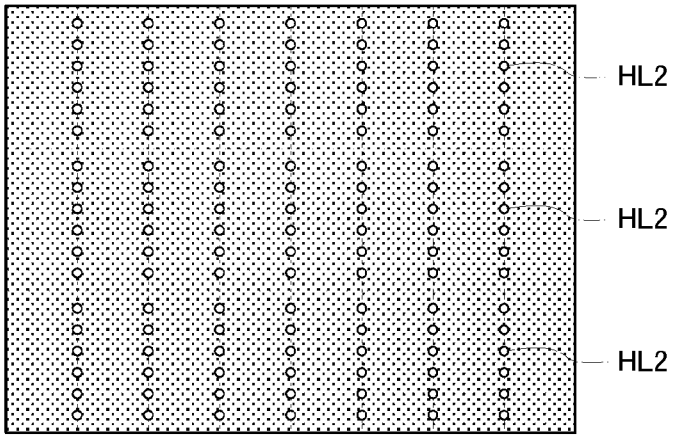
FIG. 9C FILL HOLES WITH CONDUCTIVE PASTE
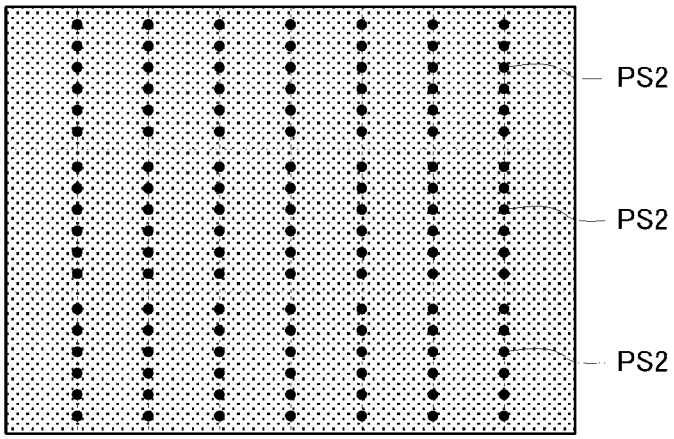

FIG. 10A PREPARE MOTHER SHEET
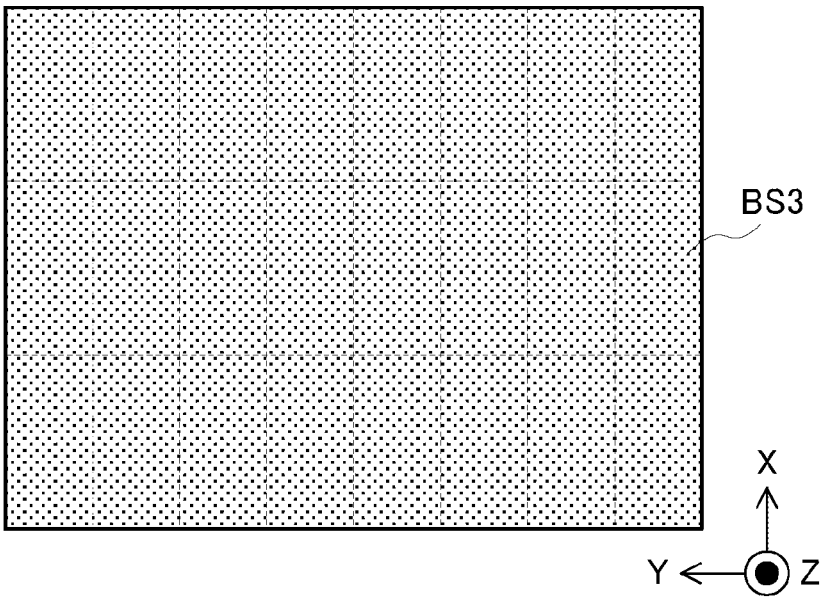
FIG. 10B FORM THROUGH-HOLES
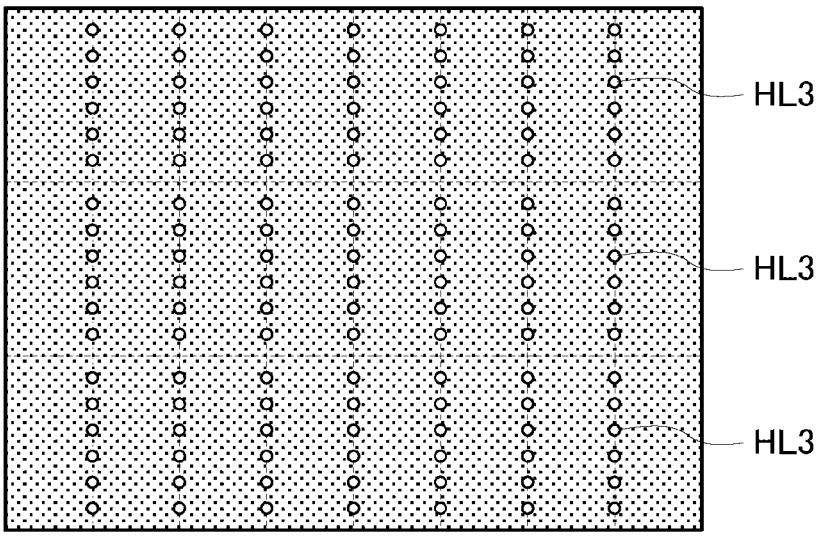

FIG. 11A FILL HOLES WITH CONDUCTIVE PASTE
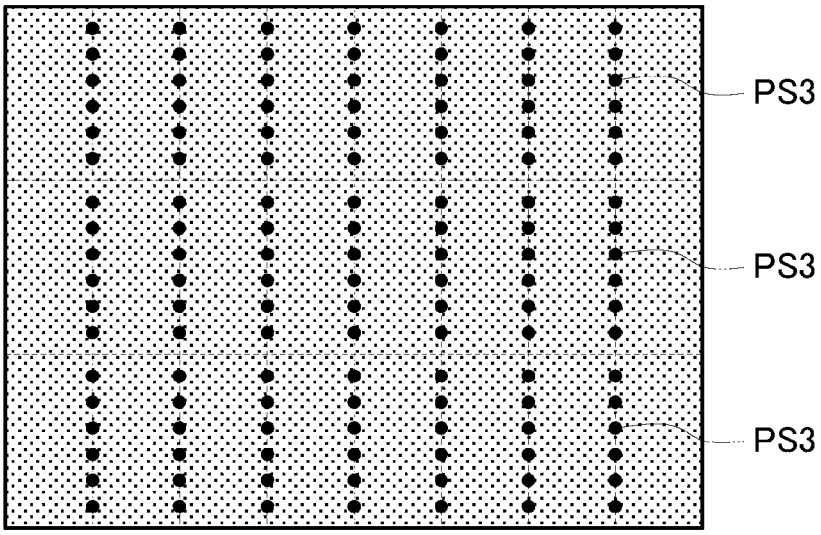
FIG. 11B PRINT COIL PATTERN
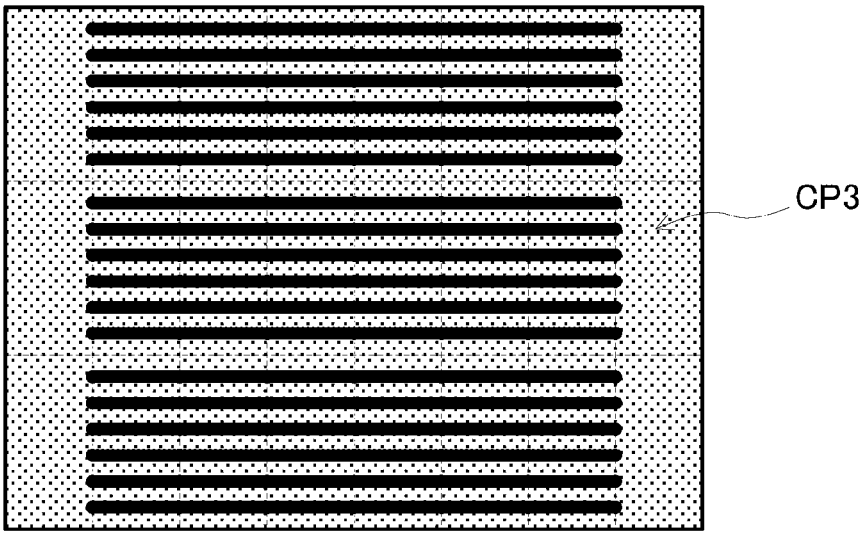

FIG. 12A PREPARE MOTHER SHEET
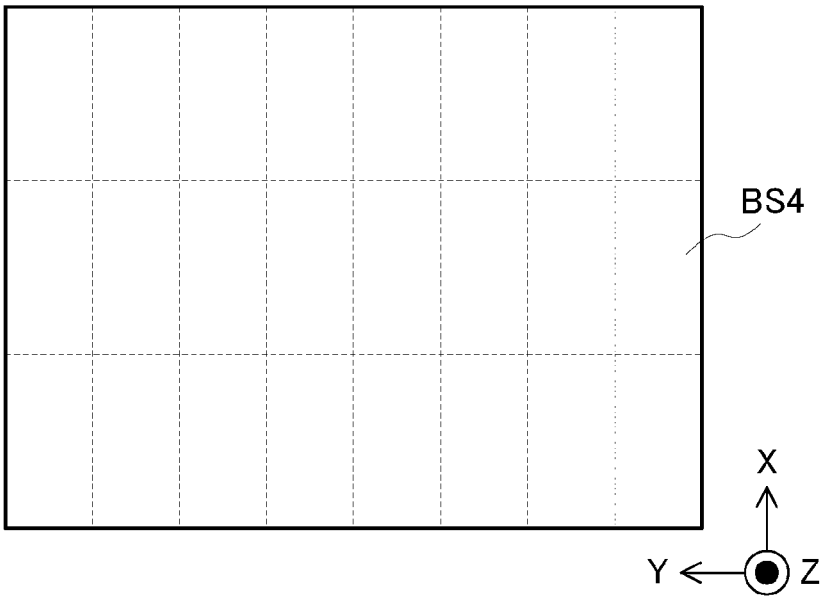
FIG. 12 B FORM THROUGH-HOLES
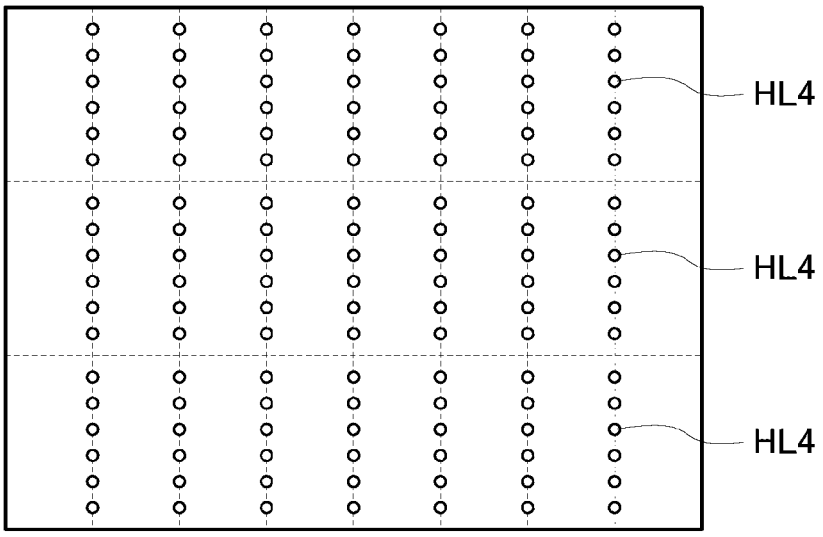

FIG. 13A FILL HOLES WITH CONDUCTIVE PASTE
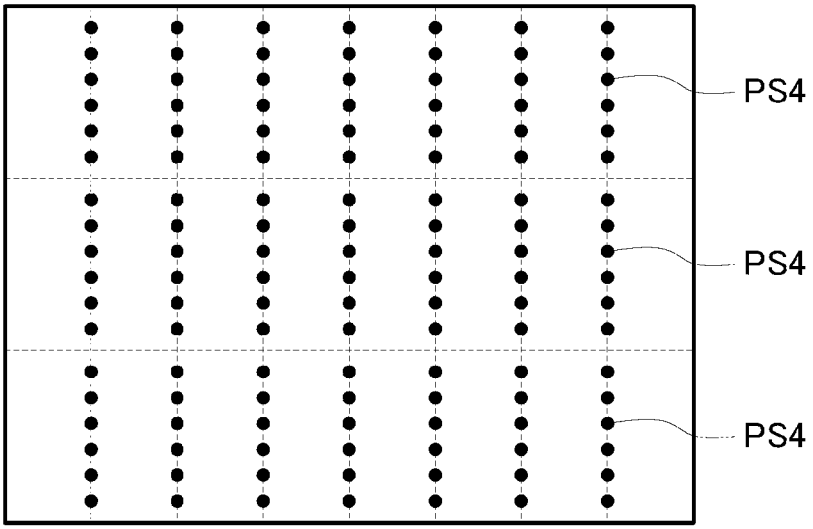
FIG. 13B PRINT COIL PATTERN
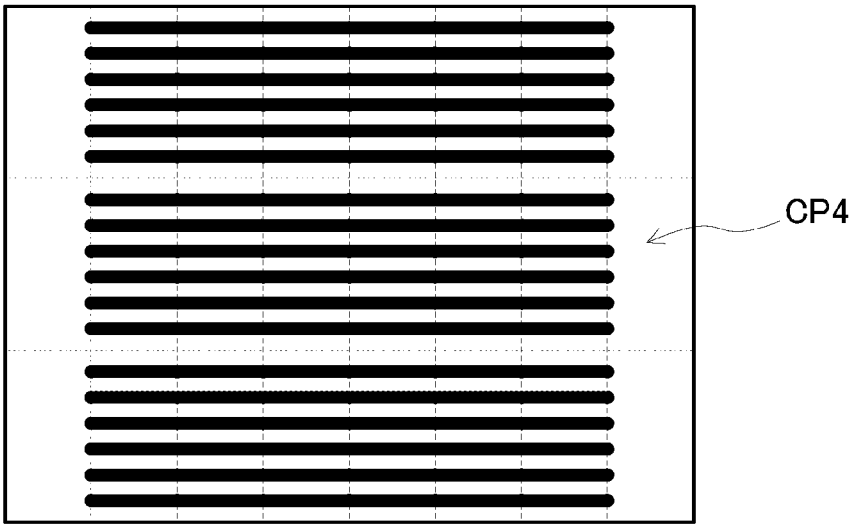

FIG. 14A STACK AND PRESS-BOND SHEETS
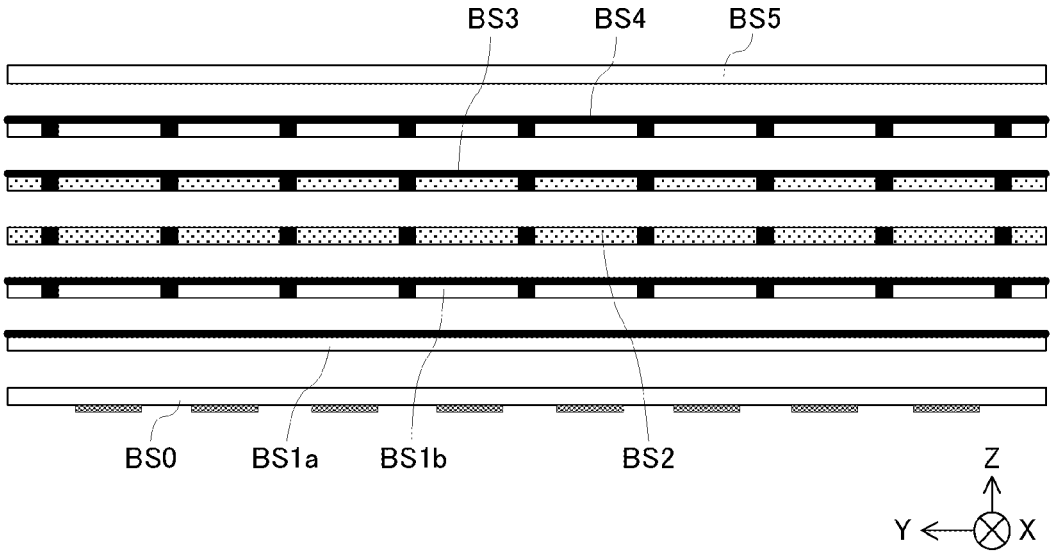
FIG.14B CUT MULTILAYER BODY INTO PIECES
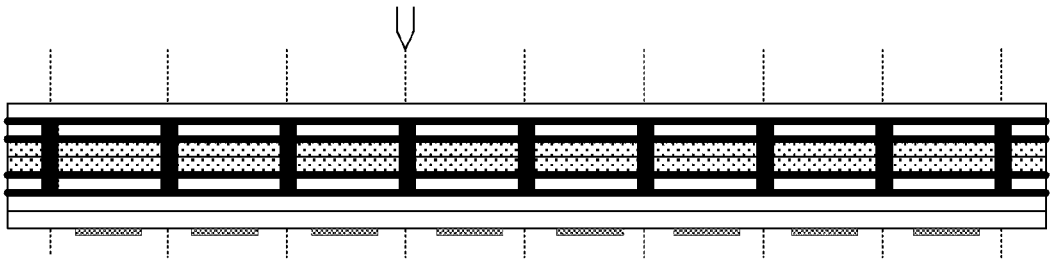
FIG.14C BARREL POLISHING & FIRING & PLATING
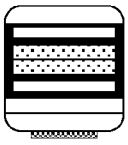

INDUCTOR ELEMENT

BACKGROUND OF THE INVENTION

1. Field of the Invention

The present invention relates to inductor elements, and particularly relates to an inductor element that is applied as an antenna coil for near field communication.

2. Description of the Related Art

An example of this type of element is disclosed in Patent Document 1. According to this related art, an antenna coil includes a magnetic core and a coil that is wound therearound in the longitudinal direction of the magnetic core. The antenna coil is fabricated by winding, around a ferrite core, a resin film that is made of polyimide or the like and has a coil pattern printed thereon.

Patent Document 1: Japanese Unexamined Patent Application Publication No. 2008-35464

BRIEF SUMMARY OF THE INVENTION

However, according to the related art, a resin film is simply wound around a ferrite core, and thus the operation performance of the element is limited.

Accordingly, a major object of the present invention is to provide an inductor element that has enhanced operation performance.

An inductor element according to the present invention is an inductor element that includes a multilayer body including three or more sheets that are stacked one on top of another, each of the sheets having a principal surface provided with a plurality of linear conductors; and a plurality of via-hole conductors or side-surface conductors that are disposed with the multilayer body so as to connect the plurality of linear conductors to one another and form an inductor. The plurality of linear conductors have a pattern that is common among at least two sheets adjacent to each other in a stacking direction.

Preferably, the three or more sheets include one or more first sheets and a plurality of second sheets (SH3 and SH4), each of the first sheets having a principal surface provided with a plurality of first linear conductors that are arranged at a predetermined interval in a first direction and that extend in a direction having a first angle with respect to the first direction, each of the second sheets having a principal surface provided with a plurality of second linear conductors that are arranged at the predetermined interval in a second direction and that extend in a direction having a second angle with respect to the second direction.

In a certain aspect, the first direction and the second direction match each other and the first sheets and the second sheets are stacked such that sheets of the same type are stacked one on top of another. Accordingly, the first linear conductors and the second linear conductors are alternately arranged along the principal surfaces when viewed from the stacking direction. A difference between a distance in the first direction from one end to another end of each of the first linear conductors and a distance in the second direction from one end to another end of each of the second linear conductors corresponds to the predetermined interval.

In another aspect, the one or more first sheets and the plurality of second sheets disposed between an inner side of the first linear conductors and an inner side of the second linear conductors are magnetic sheets.

In still another aspect, the one or more first sheets and the plurality of second sheets that are different from the one or more magnetic sheets disposed between an inner side of the first linear conductors and an inner side of the second linear conductors are nonmagnetic sheets.

According to the present invention, with a pattern of a plurality of linear conductors being common among at least two sheets, a plurality of protrusions having a pattern corresponding to this pattern are formed on a principal surface of an inductor element. Accordingly, the heat dissipation performance is enhanced. Further, with sheets provided with a plurality of linear conductors having a common pattern being adjacent to each other in a stacking direction, the plurality of linear conductors arranged in the stacking direction are connected in parallel to each other. Accordingly, DC resistance components of the inductor element are reduced, and the operation performance of the element is enhanced.

The above-described object and other objects, features, and advantages of the present invention will become more apparent from the detailed description of an embodiment that will be given with reference to the drawings.

BRIEF DESCRIPTION OF DRAWINGS

FIG. 5A is a diagram illustrating a part of a manufacturing process of the nonmagnetic sheet SH1*a*, and FIG. 5B is a diagram illustrating another part of the manufacturing process of the nonmagnetic sheet SH1*a*.

FIG. 6A is a diagram illustrating another part of the manufacturing process of the nonmagnetic sheet SH1*a*, and FIG. 6B is a diagram illustrating still another part of the manufacturing process of the nonmagnetic sheet SH1*a*.

FIG. 7A is a diagram illustrating a part of a manufacturing process of the nonmagnetic sheet SH1*b*, and FIG. 7B is a diagram illustrating another part of the manufacturing process of the nonmagnetic sheet SH1*b*.

FIG. 8A is a diagram illustrating another part of the manufacturing process of the nonmagnetic sheet SH1*b*, and FIG. 8B is a diagram illustrating still another part of the manufacturing process of the nonmagnetic sheet SH1*b*.

FIG. 9A is a diagram illustrating a part of a manufacturing process of a magnetic sheet SH2, FIG. 9B is a diagram illustrating another part of the manufacturing process of the magnetic sheet SH2, and FIG. 9C is a diagram illustrating still another part of the manufacturing process of the magnetic sheet SH2.

FIG. 10A is a diagram illustrating a part of a manufacturing process of the magnetic sheet SH3, and FIG. 10B is a diagram illustrating another part of the manufacturing process of the magnetic sheet SH3.

FIG. 11A is a diagram illustrating another part of the manufacturing process of the magnetic sheet SH3, and FIG. 11B is a diagram illustrating still another part of the manufacturing process of the magnetic sheet SH3.

FIG. 12A is a diagram illustrating a part of a manufacturing process of the nonmagnetic sheet SH4, and FIG. 12B is a diagram illustrating another part of the manufacturing process of the nonmagnetic sheet SH4.

FIG. 13A is a diagram illustrating another part of the manufacturing process of the nonmagnetic sheet SH4, and FIG. 13B is a diagram illustrating still another part of the manufacturing process of the nonmagnetic sheet SH4.

FIG. 14A is a diagram illustrating a part of a manufacturing process of the inductor element, FIG. 14B is a diagram illustrating another part of the manufacturing process of the inductor element, and FIG. 14C is a diagram illustrating still another part of the manufacturing process of the inductor element.

DETAILED DESCRIPTION OF THE INVENTION

Figure 1:
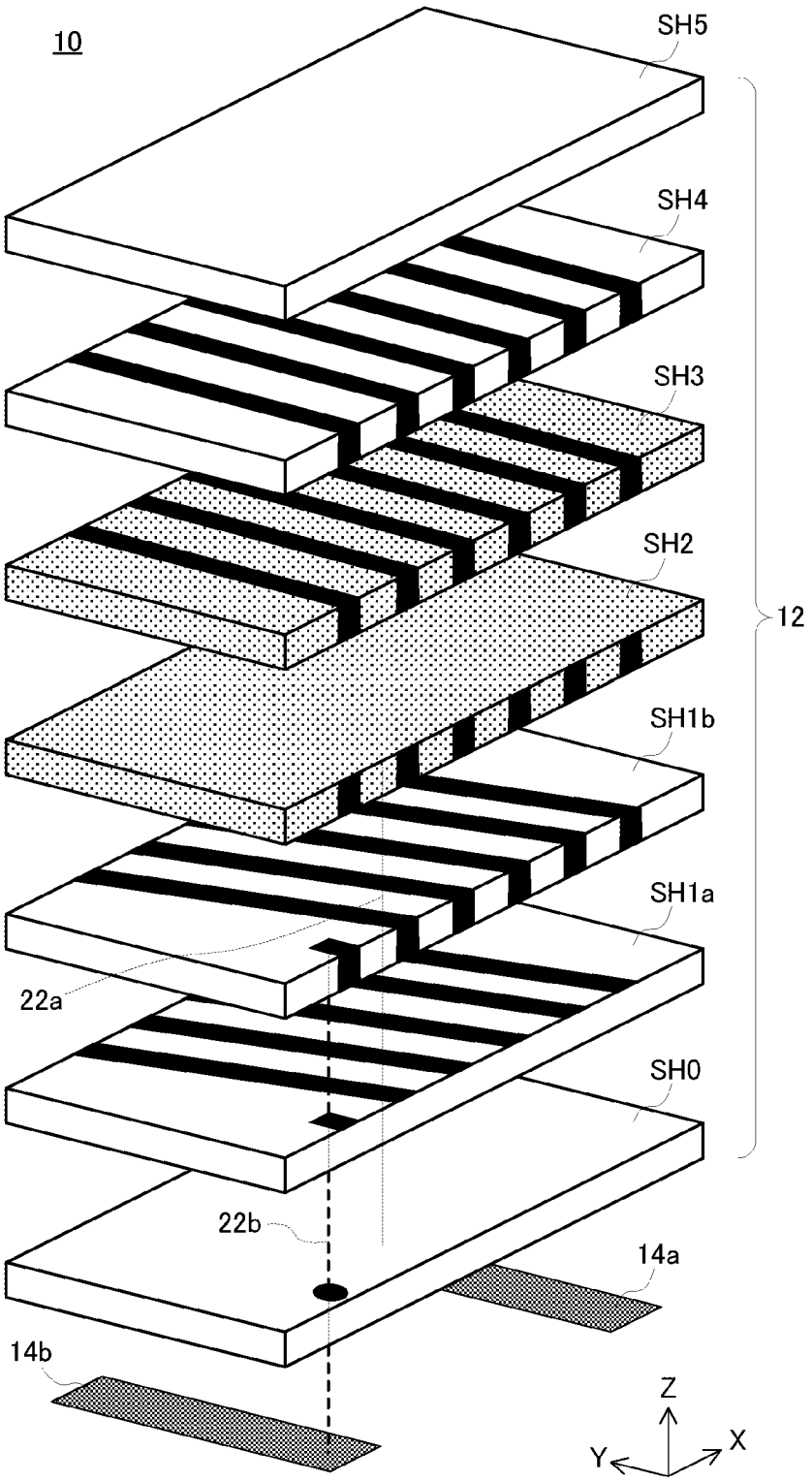
FIG. 1 is a diagram illustrating an exploded view of an inductor element according to this embodiment.

Referring to FIG. 1, a coil antenna element 10 according to this embodiment includes nonmagnetic sheets SH0, SH1*a*, SH1*b*, SH4, and SH5, and magnetic sheets SH2 and SH3, each of which has rectangular principal surfaces. These sheets are stacked in order of "SH0", "SH1*a*", "SH1*b*", "SH2", "SH3", "SH4", and "SH5", and thereby a rectangular parallelepiped multilayer body 12 is fabricated. A long side and a short side of a rectangle that forms a principal surface of the multilayer body 12 extend along an X-axis and a Y-axis, respectively, and a thickness of the multilayer body 12 increases along a Z-axis. A lower surface of the multilayer body 12 is provided with conductor terminals 14*a* and 14*b*, which are located at both ends in the X-axis direction.

The sheets SH0, SH1*a*, SH1*b*, and SH2 to SH5 have principal surfaces of the same size. The sheets SH0, SH1*a*, SH1*b*, SH4, and SH5 are made of a nonmagnetic ferrite, whereas the sheets SH2 and SH3 are made of a magnetic ferrite. Further, one principal surface and the other principal surface of the multilayer body 12 or the sheets SH0, SH1*a*, SH1*b*, and SH2 to SH5 are respectively referred to as an "upper surface" and a "lower surface" if necessary.

Figure 2A:
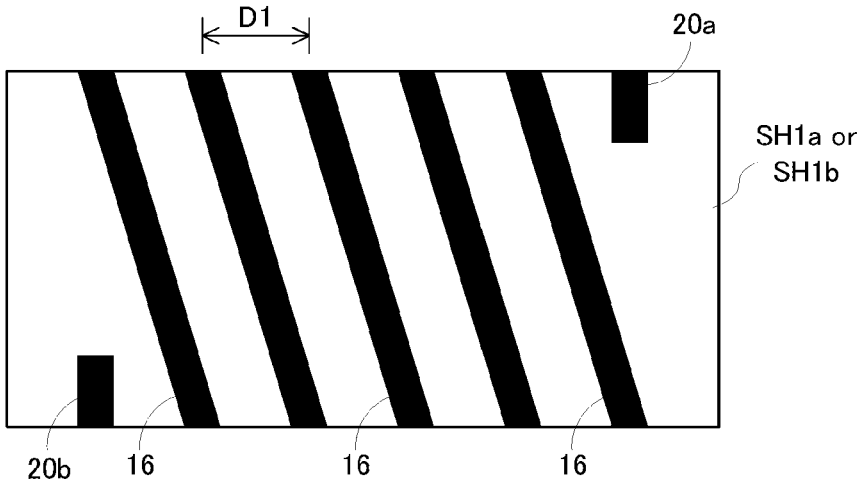
FIG. 2A is a plan view illustrating an example of a nonmagnetic sheet SH1*a* or SH1*b* included in the inductor element.
Figure 2B:
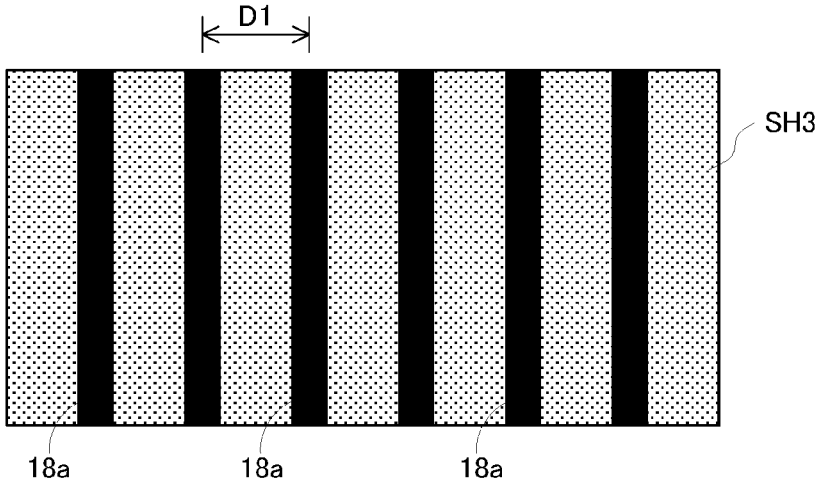
FIG. 2B is a plan view illustrating an example of a magnetic sheet SH3 included in the inductor element.
Figure 2C:
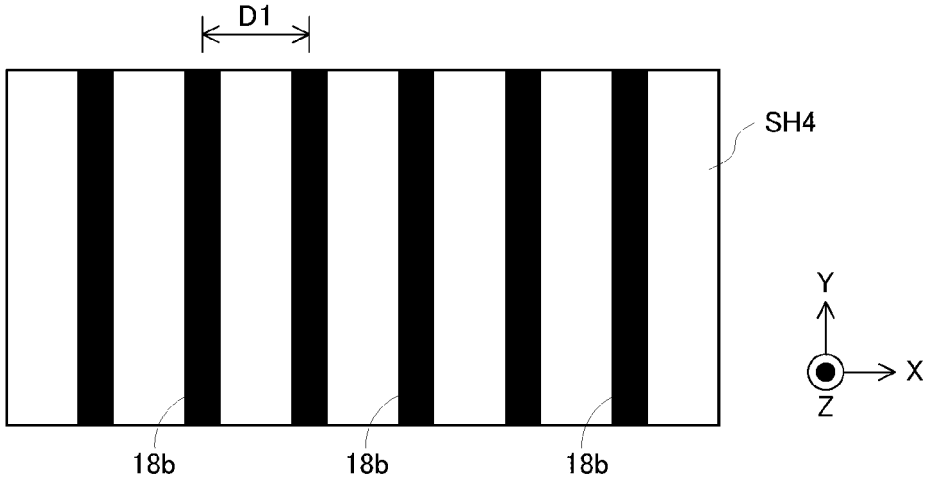
FIG. 2C is a plan view illustrating an example of a nonmagnetic sheet SH4 included in the inductor element.

As illustrated in FIG. 2A, a plurality of linear conductors 16 are disposed on the upper surfaces of the nonmagnetic sheets SH1*a* and SH1*b*. Also, as illustrated in FIG. 2B, a plurality of linear conductors 18*a* are disposed on the upper surface of the magnetic sheet SH3. Further, as illustrated in FIG. 2C, a plurality of linear conductors 18*b* are disposed on the upper surface of the nonmagnetic sheet SH4. No linear conductors exist on the upper surface of the magnetic sheet SH2, and a magnetic body is present over the entire upper surface. Likewise, no linear conductors exist on the upper surfaces of the nonmagnetic sheets SH0 and SH5, and a nonmagnetic body is present over the entire upper surfaces.

The linear conductors 16 extend in a slanting direction with respect to the Y-axis and are arranged at an interval of a distance D1 in the X-axis direction. Both ends in the length direction of each linear conductor 16 reach both edges in the Y-axis direction of the upper surface of the nonmagnetic sheet SH1*a* or SH1*b*. The two linear conductors 16 on both end sides in the X-axis direction are located on inner sides of both ends in the X-axis direction of the upper surface of the nonmagnetic sheet SH1*a* or SH1*b*.

The linear conductors 18*a* extend along the Y-axis and are arranged at an interval of the distance D1 in the X-axis direction. Both ends in the length direction of each linear conductor 18*a* reach both edges in the Y-axis direction of the upper surface of the magnetic sheet SH3. The two linear conductors 18*a* on both end sides in the X-axis direction are located on inner sides of both ends in the X-axis direction of the upper surface of the magnetic sheet SH3.

The linear conductors 18*b* extend along the Y-axis and are arranged at an interval of the distance D1 in the X-axis direction. Both ends in the length direction of each linear conductor 18*b* reach both edges in the Y-axis direction of the upper surface of the nonmagnetic sheet SH4. The two linear conductors 18*b* on both end sides in the X-axis direction are located on inner sides of both ends in the X-axis direction of the upper surface of the nonmagnetic sheet SH4.

The arrangement of the linear conductors 18*b* on the nonmagnetic sheet SH4 matches the arrangement of the linear conductors 18*b* on the magnetic sheet SH3. Thus, the linear conductors 18*b* completely overlap the linear conductors 18*a* when viewed from the Z-axis direction.

In contrast, regarding the nonmagnetic sheet SH1*a* or SH1*b*, a distance in the X-axis direction from one end to the other end of each linear conductor 16 corresponds to "D1". In other words, the difference between the distance in the X-axis direction from one end to the other end of each linear conductor 16 and a distance in the X-axis direction from one end to the other end of each linear conductor 18*a* (or 18*b*) corresponds to "D1".

The position of one end of each linear conductor 16 is adjusted to a position that overlaps one end of a corresponding one of the linear conductors 18*a* or 18*b* when viewed from the Z-axis direction. The number of linear conductors 16 is smaller by one than the number of linear conductors 18*a* (=the number of linear conductors 18*b*).

Thus, when viewed from the Z-axis direction, the most part of each linear conductor 16 is sandwiched between two adjacent linear conductors 18*a* (or two adjacent linear conductors 18*b*). That is, when viewed from the Z-axis direction, the linear conductors 16 and 18*a* (or 18*b*) are alternately arranged in the X-axis direction.

On the upper surfaces of the nonmagnetic sheets SH1*a* and SH1*b*, plate-like conductors 20*a* and 20*b* are also disposed. The plate-like conductor 20*a* is disposed at a position that is a little toward the negative side of the positive end in the X-axis direction and at the positive edge in the Y-axis direction. The plate-like conductor 20*b* is disposed at a position that is a little toward the positive side of the negative end in the X-axis direction and at the negative edge in the Y-axis direction. A distance from the plate-like conductor 20*a* to one end of the linear conductor 16 that is at the most positive side in the X-axis direction corresponds to "D1", and also a distance from the plate-like conductor 20*b* to the other end of the linear conductor 16 that is at the most negative side in the X-axis direction corresponds to "D1".

As illustrated in FIG. 1, the plate-like conductors 20*a* disposed on the individual nonmagnetic sheets SH1*a* and SH1*b* are connected to the conductor terminal 14*a* via a via-hole conductor 22*a*. Also, the plate-like conductors 20*b* disposed on the individual nonmagnetic sheets SH1*a* and SH1*b* are connected to the conductor terminal 14*b* via a via-hole conductor 22*b*.

Figure 3:
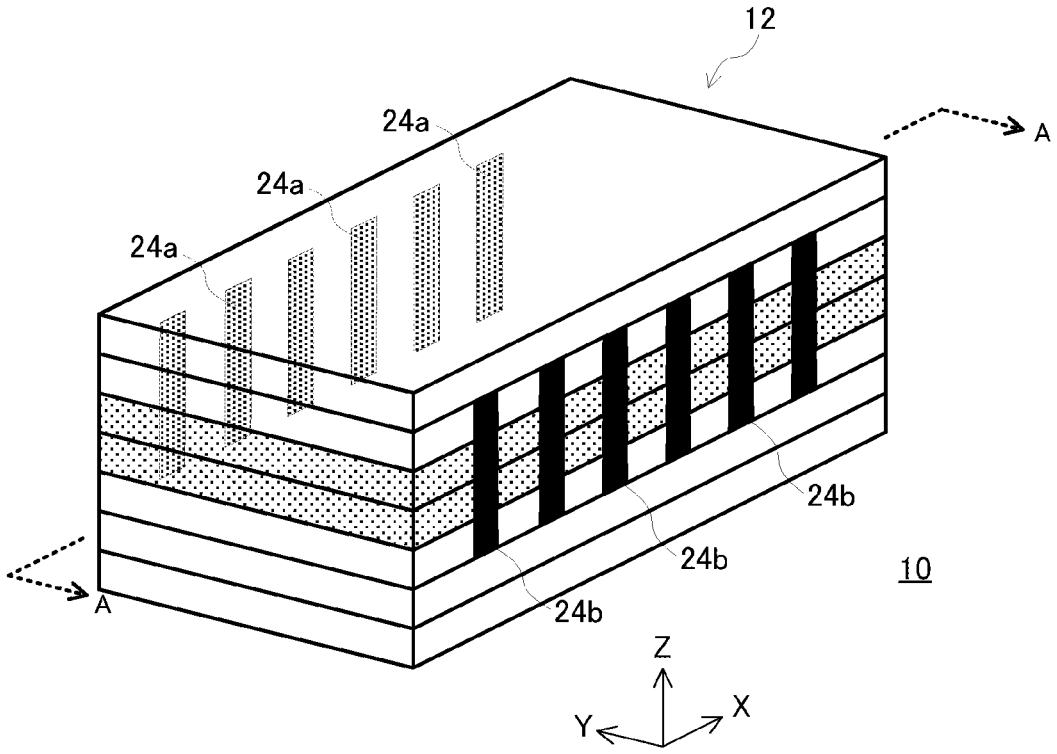
FIG. 3 is a perspective view illustrating an appearance of the inductor element according to this embodiment.

Referring to FIG. 3, a plurality of via-hole conductors (or side-surface conductors) 24*a* that extend in the Z-axis direction are disposed on a side surface on the positive side in the Y-axis direction of the multilayer body 12. Also, a plurality of via-hole conductors (or side-surface conductors) 24*b* that extend in the Z-axis direction are disposed on a side surface on the negative side in the Y-axis direction of the multilayer body 12.

The number of via-hole conductors 24*a* is the same as the number of linear conductors 18*a* (or linear conductors 18*b*), and the number of via-hole conductors 24*b* is the same as the number of linear conductors 18*a* (or linear conductors 18*b*). The individual via-hole conductors 24*a* and 24*b* are arranged at an interval of the distance D1 in the X-axis direction. Further, the via-hole conductor 24*a* that is on the most positive side in the X-axis direction is connected to the plate-like conductors 20*a*, and the via-hole conductor 24*b* that is on the most negative side in the X-axis direction is connected to the plate-like conductors 20*b*.

Accordingly, the linear conductors 16 disposed on the nonmagnetic sheet SH1*b*, the linear conductors 18*a* disposed on the magnetic sheet SH3, and the via-hole conductors 24*a* and 24*b* form a coil conductor (winding body). A magnetic body is disposed on an inner side of the coil conductor. Further, two linear conductors 16 that overlap each other when viewed from the Z-axis direction are connected in parallel to each other with a nonmagnetic body interposed therebetween. Also, two linear conductors 18*a* and 18*b* that overlap each other when viewed from the Z-axis direction are connected in parallel to each other with a nonmagnetic body interposed therebetween.

Figure 4:
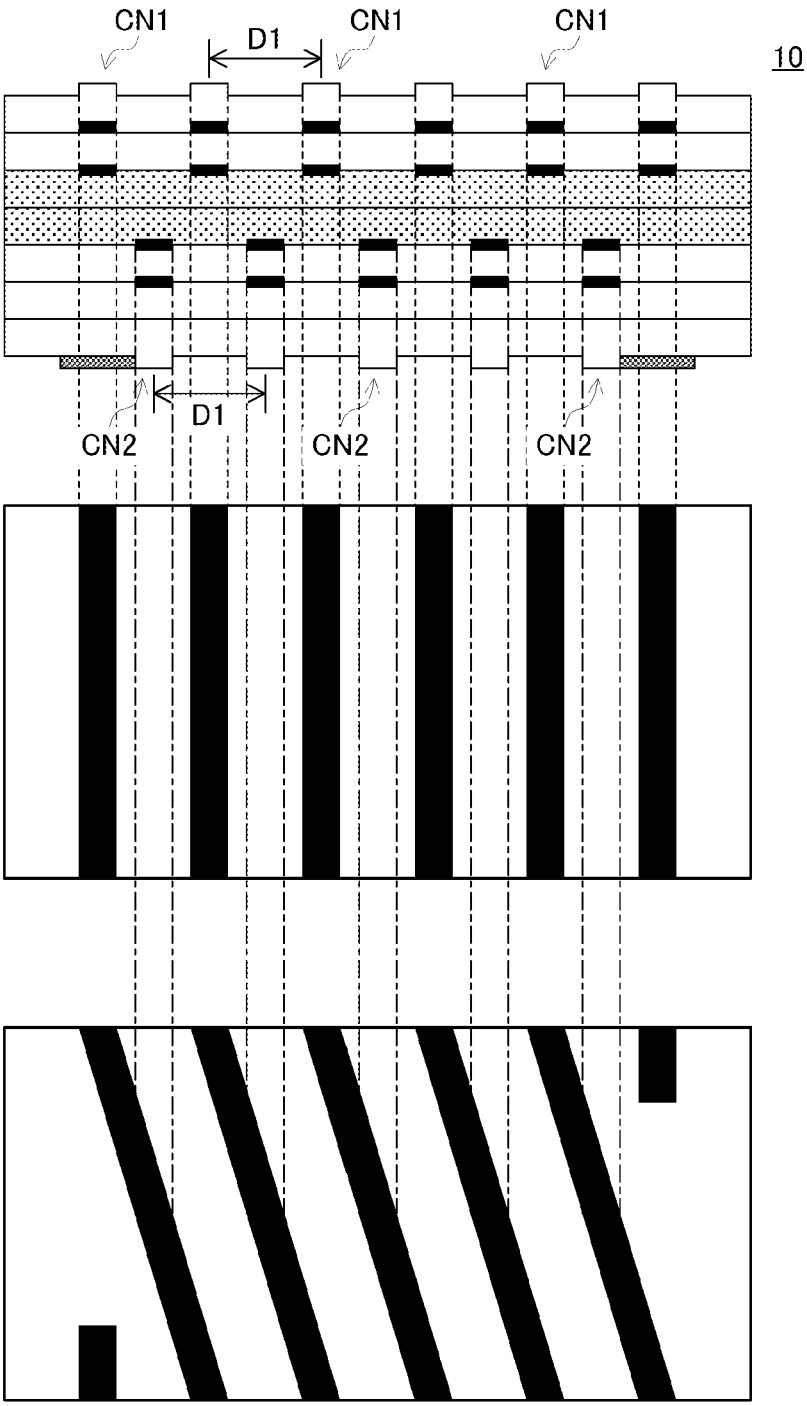
FIG. 4 is a diagram illustrating the structure of an A-A cross section of the inductor element illustrated in FIG. 3.

Referring to FIG. 4, a plurality of protrusions CN1 are disposed on the upper surface of the inductor element 10. The protrusions CN1 are arranged at an interval of the distance D1 in the X-axis direction and extend along the Y-axis. Also, a plurality of protrusions CN2 are disposed on the lower surface of the inductor element 10. The protrusions CN2 are arranged at an interval of the distance D1 in the X-axis direction and extend in a slanting direction with respect to the Y-axis.

The protrusions CN1 and CN2 are formed as a result of stacking a plurality of sheets having a common conductor pattern. The protrusions CN1 and CN2 are formed at the time when firing (described below) is completed. As a result of forming the protrusions CN1 and CN2 in this way, the heat dissipation performance of the inductor element 10 is enhanced. Further, as a result of connecting in parallel two linear conductors 16 (or 18*a* and 18*b*) that overlap each other when viewed from the Z-axis direction, DC resistance components of the inductor element 10 are reduced. Accordingly, the operation performance of the inductor element 10 can be enhanced.

The nonmagnetic sheet SH1*a* is fabricated in the manner illustrated in FIG. 5A, FIG. 5B, FIG. 6A, and FIG. 6B. First, a ceramic green sheet made of a nonmagnetic ferrite material is prepared as a mother sheet BS1*a* (see FIG. 5A). Here, a plurality of broken lines extending in the X-axis direction and the Y-axis direction indicate cutting positions.

Subsequently, a plurality of through-holes HL1*a* are formed at positions near intersections of the broken lines in the mother sheet BS1 (see FIG. 5B), and the through-holes HL1*a* are filled with a conductive paste PS1*a* (see FIG. 6A). The conductive paste PS1*a* that has filled the through-holes HL1*a* forms the via-hole conductor 22*a* or 22*b*.

After filling with the conductive paste PS1*a* has been completed, a coil pattern CP1*a* that forms the linear conductors 16 and the plate-like conductors 20*a* and 20*b* is printed on one principal surface of the mother sheet BS1*a* (see FIG. 6B).

The nonmagnetic sheet SH0 is fabricated by forming through-holes that are the same as the through-holes HL1*a* illustrated in FIG. 5B in a mother board, filling the through-holes with a conductive paste, and printing the conductor terminals 14*a* and 14*b* on the lower surface of the mother board.

The nonmagnetic sheet SH1*b* is fabricated in the manner illustrated in FIG. 7A, FIG. 7B, FIG. 8A, and FIG. 8B. First, a ceramic green sheet made of a nonmagnetic ferrite material is prepared as a mother sheet BS1*b* (see FIG. 7A). Here, a plurality of broken lines extending in the X-axis direction and the Y-axis direction indicate cutting positions.

Subsequently, a plurality of through-holes HL1*b*_1 are formed near intersections of the broken lines in the mother sheet BS1*b*, and a plurality of through-holes HL1*b*_2 are formed along the broken lines extending in the X-axis direction in the mother sheet BS1*b* (see FIG. 7B). The through-holes HL1*b*_1 are filled with a conductive paste PS1*b*_1, and the through-holes HL1*b*_2 are filled with a conductive paste PS1*b*_2 (see FIG. 8A). The conductive paste PS1*b*_1 forms the via-hole conductor 22*a* or 22*b*, and the conductive paste PS1*b*_2 forms the via-hole conductors 24*a* or 24*b*.

After filling with the conductive paste PS1*b*_1 or PS1*b*_2 has been completed, a coil pattern CP1*b* that forms the linear conductors 16 and the plate-like conductors 20*a* and 20*b* is printed on one principal surface of the mother sheet BS1*b* (see FIG. 8B).

The magnetic sheet SH2 is fabricated in the manner illustrated in FIG. 9A to FIG. 9C. First, a ceramic green sheet made of a magnetic ferrite material is prepared as a mother sheet BS2 (see FIG. 9A). Here, a plurality of broken lines extending in the X-axis direction and the Y-axis direction indicate cutting positions. Subsequently, a plurality of through-holes HL2 are formed along the broken lines extending in the X-axis direction in the mother sheet BS2 (see FIG. 9B), and the through-holes HL2 are filled with a conductive paste PS2 that forms the via-hole conductors 24*a* or 24*b* (see FIG. 9C).

The magnetic sheet SH3 is fabricated in the manner illustrated in FIG. 10A, FIG. 10B, FIG. 11A, and FIG. 11B. First, a ceramic green sheet made of a magnetic ferrite material is prepared as a mother sheet BS3 (see FIG. 10A). Here, a plurality of broken lines extending in the X-axis direction and the Y-axis direction indicate cutting positions.

Subsequently, a plurality of through-holes HL3 are formed along the broken lines extending in the X-axis direction in the mother sheet BS3 (see FIG. 10B), and the through-holes HL3 are filled with a conductive paste PS3 that forms the via-hole conductors 24*a* or 24*b* (see FIG. 11A). After filling with the conductive paste PS3 has been completed, a coil pattern CP3 that forms the linear conductors 18*a* is printed on one principal surface of the mother sheet BS3 (see FIG. 11B).

The nonmagnetic sheet SH4 is fabricated in the manner illustrated in FIG. 12A, FIG. 12B, FIG. 13A, and FIG. 13B. First, a ceramic green sheet made of a nonmagnetic ferrite material is prepared as a mother sheet BS4 (see FIG. 12A). Here, a plurality of broken lines extending in the X-axis direction and the Y-axis direction indicate cutting positions.

Subsequently, a plurality of through-holes HL4 are formed along the broken lines extending in the X-axis direction in the mother sheet BS4 (see FIG. 12B), and the through-holes HL4 are filled with a conductive paste PS4 that forms the via-hole conductors 24*a* or 24*b* (see FIG. 13A). After filling with the conductive paste PS4 has been completed, a coil pattern CP4 that forms the linear conductors 18*b* is printed on one principal surface of the mother sheet BS4 (see FIG. 13B).

The mother sheets BS1*a*, BS1*b*, and BS2 to BS4 that have undergone the above-described steps, a mother sheet BS0 corresponding to the nonmagnetic sheet SH0, and a mother sheet BS5 corresponding to the nonmagnetic sheet SH5 are press-bonded to one another with being stacked in the manner illustrated in FIG. 14A. According to FIG. 14A, the mother sheets BS0, BS1*a*, BS1*b*, and BS2 to BS5 are stacked in this order. At this time, the stacking positions of the individual sheets are adjusted so that the broken lines assigned to the individual sheets overlap one another when viewed from the Z-axis direction.

The multilayer body obtained through the press-bonding is cut along the above-described broken lines into individual pieces before firing (see FIG. 14B). After that, the individual pieces undergo a series of processes including barrel polishing, firing, and plating (see FIG. 14C), and accordingly the inductor element 10 is completed.

As is understood from the description given above, the multilayer body 12 includes the nonmagnetic sheets SH1*a* and SH1*b* each having the upper surface provided with the plurality of linear conductors 16; the magnetic sheet SH3 having the upper surface provided with the plurality of linear conductors 18*a*; and the nonmagnetic sheet SH4 having the upper surface provided with the plurality of linear conductors 18*b*, which are stacked one on top of another. The plurality of via-hole conductors 24*a* and 24*b* are disposed in the multilayer body 12 so as to connect these linear conductors to one another and form an inductor. Here, the plurality of linear conductors have a pattern that is common among at least two sheets adjacent to each other in the stacking direction.

With a pattern of a plurality of linear conductors being common among at least two sheets, the plurality of protrusions CN1 and CN2 having a pattern corresponding to this pattern are formed on the principal surfaces of the inductor element 10. Accordingly, the heat dissipation performance is enhanced. Further, with sheets provided with a plurality of linear conductors having a common pattern being adjacent to each other in the stacking direction, a plurality of linear conductors arranged in the stacking direction are connected in parallel to each other. Accordingly, DC resistance components of the inductor element 10 are reduced, and the operation performance of the inductor element 10 is enhanced.

More specifically, the plurality of linear conductors 16 that are arranged at an interval of the distance D1 in the X-axis direction and that extend in a slanting direction with respect to the Y-axis are disposed on the upper surfaces of the nonmagnetic sheets SH1*a* and SH1*b*. Also, the plurality of linear conductors 18*a* or 18*b* that are arranged at an interval of the distance D1 in the X-axis direction and that extend in the Y-axis direction are disposed on the upper surfaces of the magnetic sheet SH3 and the nonmagnetic sheet SH4.

Here, the nonmagnetic sheets SH1*a* and SH1*b* and the magnetic sheet SH3 and the nonmagnetic sheet SH4 are stacked such that sheets of the same type are stacked one on top of another and that the linear conductors 16 and 18*a* (or 18*b*) are alternately arranged along the upper surfaces when viewed from the Z-axis direction. The difference between the distance in the X-axis direction from one end to the other end of each linear conductor 16 and the distance in the X-axis direction from one end to the other end of each linear conductor 18*a* (or 18*b*) corresponds to the distance D1. Further, the via-hole conductors 24*a* that extend from one ends of the linear conductors 16 in the Z-axis direction and the via-hole conductors 24*b* that extend from the other ends of the linear conductors 16 in the Z-axis direction are disposed in the multilayer body 12.

With a plurality of sheets having a common conductor pattern being stacked one on top of another, the plurality of protrusions CN1 that are arranged at an interval of the distance D1 in the X-axis direction and that extend in the Y-axis direction are formed on the upper surface of the inductor element 10. Accordingly, the heat dissipation performance is enhanced. Further, with the via-hole conductors 24*a* and 24*b* that respectively extend from one ends and the other ends of the linear conductors 16 in the Z-axis direction being disposed, a coil conductor is formed, and two linear conductors 16 or two linear conductors 18*a* and 18*b* that exist at the same position viewed from the Z-axis direction are connected in parallel to each other. Accordingly, DC resistance components of the inductor element 10 are reduced, and the operation performance of the element can be enhanced.

In this embodiment, the nonmagnetic sheets SH1*a* and SH1*b* that have a common conductor pattern are stacked one on top of another, and also the magnetic sheet SH3 and the nonmagnetic sheet SH4 that have another common conductor pattern are stacked one on top of another. However, the heat dissipation performance is enhanced if at least one of the nonmagnetic sheets SH1*a* and SH4 exists. Thus, one of the nonmagnetic sheets SH1*a* and SH4 may be used, and the other may be omitted.

In this embodiment, the linear conductors 16 extend in a slanting direction with respect to the Y-axis, whereas the linear conductors 18*a* and 18*b* extend in the Y-axis direction. However, the linear conductors 18*a* and 18*b* may extend in a slanting direction as long as the difference between the distance in the X-axis direction from one end to the other end of each linear conductor 16 and the distance in the X-axis direction from one end to the other end of each linear conductor 18*a* (or 18*b*) is adjusted to D1.

Further, in this embodiment, the via-hole conductor 24*a* that exists on the most positive side in the X-axis direction is connected to the conductor terminal 14*a* via the plate-like conductors 20*a* and the via-hole conductor 22*a*, and the via-hole conductor 24*b* that exists on the most negative side in the X-axis direction is connected to the conductor terminal 14*b* via the plate-like conductors 20*b* and the via-hole conductor 22*b* (see FIG. 1, FIG. 2A, and FIG. 3). However, in a case where side-surface conductors of the inductor element 10 are mounted as terminal electrodes on a printed wiring board, the plate-like conductors 20*a* and 20*b*, the via-hole conductors 22*a* and 22*b*, and the conductor terminals 14*a* and 14*b* are not necessary.

The present invention has been described and illustrated in detail. It is obvious that the description and illustration have been given merely as illustration and an example, and should not be interpreted as limitation. The spirit and scope of the present invention are limited only by the description of the attached claims.

10 inductor element
SH0, SH1*a*, SH1*b*, SH4, SH5 nonmagnetic sheet
SH2, SH3 magnetic sheet
16, 18*a*, 18*b* linear conductor
22*a*, 22*b*, 24*a*, 24*b* via-hole conductor

The invention claimed is:

1. An inductor element comprising:

a multilayer body including three or more sheets that are stacked one on top of another, each of the sheets having a principal surface provided with a plurality of linear conductors; and a plurality of via-hole conductors that are disposed with the multilayer body so as to connect the plurality of linear conductors to one another to form the inductor; and a plurality of protrusions on upper and lower surfaces of the multilayer body arranged at a same interval, wherein the plurality of linear conductors have a pattern that is common among at least two sheets adjacent to each other in a stacking direction, the plurality of protrusions have a protrusion pattern corresponding to the pattern of the plurality of linear conductors that is common among the at least two sheets adjacent to each other, a nonmagnetic body is disposed between adjacent ones of the plurality of linear conductors having the pattern that is common among the at least two sheets adjacent to each other in the stacking direction, the three or more sheets include one or more first sheets and a plurality of second sheets, each of the first sheets has a principal surface provided with a plurality of first linear conductors that are arranged at a same interval in a first direction and that extend in a direction having a first angle with respect to the first direction, each of the second sheets has a principal surface provided with a plurality of second linear conductors that are arranged at a same interval in a second direction and that extend in a direction having a second angle with respect to the second direction, the first linear conductors and second linear conductors form a coil conductor, the one or more first sheets and the plurality of second sheets disposed on an inner side of the coil conductor comprise one or more magnetic sheets, and the plurality of via-hole conductors arranged at the one or more magnetic sheets are side surface conductors.

2. The inductor element according to claim 1, wherein the first direction matches the second direction, wherein the first sheets and the second sheets are stacked such that sheets of the same type are stacked one on top of another and that the first linear conductors and the second linear conductors are alternately arranged along the principal surfaces when viewed from the stacking direction, and wherein a difference between a distance in the first direction from one end to another end of each of the first linear conductors and a distance in the second direction from one end to another end of each of the second linear conductors corresponds to the same interval.

3. The inductor element according to claim 1, wherein, the one or more first sheets and the plurality of second sheets that are different from one or more sheets disposed on an inner side of the coil conductor comprise one or more nonmagnetic sheets.

4. The inductor element according to claim 2, wherein the first linear conductors and second linear conductors form a coil conductor.

5. The inductor element according to claim 4, wherein, the one or more first sheets and the plurality of second sheets disposed on an inner side of the coil conductor comprise one or more magnetic sheets.

6. The inductor element according to claim 4, wherein, the one or more first sheets and the plurality of second sheets that are different from one or more sheets disposed on an inner side of the coil conductor comprise one or more magnetic sheets.

7. The inductor element according to claim 1, wherein, the one or more first sheets and the plurality of second sheets that are different from the one or more sheets disposed on the inner side of the coil conductor comprise one or more nonmagnetic sheets.

* * * * *